US012663010B2

(12) United States Patent
Nayak

(10) Patent No.: US 12,663,010 B2
(45) Date of Patent: Jun. 23, 2026

(54) CENTRIFUGAL-TYPE ELECTRIC REFRIGERANT COMPRESSOR HAVING INTEGRAL ORIFICE-REGULATED BEARING COOLING ARRANGEMENT

(71) Applicant: Garrett Transportation I Inc., Torrance, CA (US)

(72) Inventor: Ankur Nayak, Bangalore (IN)

(73) Assignee: Garrett Transportation I Inc., Torrance, CA (US)

( * ) Notice: Subject to any disclaimer, the term of this patent is extended or adjusted under 35 U.S.C. 154(b) by 0 days.

(21) Appl. No.: 18/365,214

(22) Filed: Aug. 4, 2023

(65) Prior Publication Data

US 2024/0426305 A1 Dec. 26, 2024

(51) Int. Cl.

| | |
|---|---|
| ***F04D 25/06*** | (2006.01) |
| ***F04D 29/58*** | (2006.01) |
| ***F25B 31/00*** | (2006.01) |

(52) U.S. Cl.

CPC ..... *F04D 25/06* (2013.01); *F04D 29/5806* (2013.01); *F04D 29/582* (2013.01); *F04D 29/584* (2013.01); *F25B 31/006* (2013.01)

(58) Field of Classification Search

CPC .... F04D 29/5806; F04D 29/582; F04D 29/58; F04D 29/584; F04D 25/06; F25B 31/006

See application file for complete search history.

(56) References Cited

U.S. PATENT DOCUMENTS

| | | | | | |
|---|---|---|---|---|---|
| 3,220,350 | A * | 11/1965 | White | F04D 13/0613 | 417/357 |
| 3,280,750 | A * | 10/1966 | White | F04D 13/0613 | 417/357 |
| RE26,438 | E * | 8/1968 | White | F04D 13/0613 | 417/357 |
| 4,652,218 | A * | 3/1987 | Tsutsui | F04D 13/064 | 417/370 |
| 5,248,245 | A * | 9/1993 | Behnke | F04D 13/026 | 415/110 |
| 5,322,421 | A * | 6/1994 | Hansen | F04C 15/0096 | 417/420 |
| 5,997,261 | A * | 12/1999 | Kershaw | F04D 29/5813 | 417/357 |
| 6,111,334 | A * | 8/2000 | Horski | H02K 1/02 | 310/216.057 |
| 6,447,269 | B1 * | 9/2002 | Rexroth | F04D 29/588 | 417/370 |
| 6,884,043 | B2 * | 4/2005 | Kimberlin | F04C 14/06 | 417/357 |
| 6,986,648 | B2 * | 1/2006 | Williams | F04D 13/064 | 417/370 |
| 7,704,056 | B2 * | 4/2010 | Masoudipour | F04D 25/0606 | 62/505 |

(Continued)

FOREIGN PATENT DOCUMENTS

EP 2715140 B1 4/2014

*Primary Examiner* — Christopher S Bobish
(74) *Attorney, Agent, or Firm* — BelalyIP

(57) ABSTRACT

An E-compressor for an AC system of an electric vehicle provides a cooling flow of refrigerant via a fixed orifice disposed internally within the housing assembly of the compressor. A portion of the pressurized refrigerant to be supplied to the AC system is bled off through the fixed orifice and provided to a cooling flow path that directs the bleed portion into the bearing areas of the compressor.

19 Claims, 6 Drawing Sheets

(56) References Cited

U.S. PATENT DOCUMENTS

| | | | | |
|---|---|---|---|---|
| 8,272,832 | B2 * | 9/2012 | Yin | F04D 29/685 415/206 |
| 8,931,304 | B2 | 1/2015 | Beers et al. | |
| 9,163,635 | B2 * | 10/2015 | Chiu | F04D 13/0606 |
| 9,291,167 | B2 * | 3/2016 | Schreiber | H02K 1/20 |
| 9,616,188 | B2 * | 4/2017 | Grasmuck | F04D 29/584 |
| 9,671,139 | B2 * | 6/2017 | Creamer | F04D 29/5806 |
| 9,732,766 | B2 * | 8/2017 | Thompson | F04D 29/584 |
| 11,002,287 | B2 * | 5/2021 | Ahn | F04D 29/5806 |
| 11,566,537 | B2 * | 1/2023 | Marques | F04D 29/4213 |
| 11,965,505 | B2 * | 4/2024 | Crosio | F04C 2/08 |
| 11,976,658 | B2 * | 5/2024 | Liu | F04C 11/008 |
| 2012/0288380 | A1 * | 11/2012 | Kaiser | F04C 15/008 417/321 |
| 2015/0267717 | A1 * | 9/2015 | Fujii | F04D 29/057 415/220 |
| 2017/0082119 | A1 * | 3/2017 | Schreiber | F04D 17/10 |
| 2018/0320778 | A1 * | 11/2018 | Rosinski | F16H 57/12 |
| 2021/0293253 | A1 * | 9/2021 | Chavez Castellanos | F04D 29/5806 |
| 2023/0160390 | A1 * | 5/2023 | Ishihara | F04D 29/0513 417/354 |
| 2023/0204037 | A1 * | 6/2023 | Mori | F04D 25/0606 417/350 |

* cited by examiner

CENTRIFUGAL-TYPE ELECTRIC REFRIGERANT COMPRESSOR HAVING INTEGRAL ORIFICE-REGULATED BEARING COOLING ARRANGEMENT

BACKGROUND OF THE INVENTION

This application relates generally to automotive vehicles, and particularly to air conditioning systems for vehicles. The application relates more specifically to electric refrigerant compressors for AC systems in automotive vehicles.

Developments in automotive technology are increasingly moving toward "greener" vehicles that reduce or eliminate carbon emissions, necessitated in some cases by ever more-stringent government-imposed regulations. Various designs for electric vehicles have been proposed and developed, including hybrid electric vehicles (HEVs), plug-in hybrid electric vehicles (PHEVs), and battery electric vehicles (BEVs). All these types of vehicles include a battery as a power source, but in the case of HEVs and PHEVs, the battery is small and is used only for supplementing an internal combustion engine (ICE) that serves as the primary power source for causing the vehicle to move. On the other hand, in BEVs, the battery is quite large and is the sole source for all power needs of the vehicle. Accordingly, in BEVs all the typical equipment that modern vehicles include must derive their power from the battery. This includes the air conditioning system of the vehicle.

A vehicle air conditioning system works by removing heat and moisture from the air inside the passenger cabin, and then circulating cooler and drier air back into the cabin. Vehicle AC systems typically include a compressor, a condenser, an expansion valve, and an evaporator, together with a blower for circulating the cabin air. The compressor is driven to compress and circulate a refrigerant gas (such as R134a) through the system. The compressed refrigerant gas flows through the condenser, which is essentially a heat exchanger that dissipates the heat that the refrigerant has absorbed from the air inside the vehicle cabin. As the refrigerant cools, it condenses into a liquid. The liquid refrigerant then passes through the expansion valve, which regulates the flow of refrigerant and causes it to undergo a substantial drop in pressure and temperature. The cold gaseous refrigerant then passes through the evaporator, which again is essentially a heat exchanger, located inside the vehicle. As the cold, low-pressure refrigerant passes through the evaporator, it absorbs heat from the cabin air circulated over the evaporator by the blower, causing the refrigerant to evaporate and return to a gaseous state. The evaporated refrigerant then circulates back to the compressor.

The AC system continues to circulate the refrigerant, removing heat and moisture from the air inside the vehicle and replacing it with cooler, drier air. The cycle continues until the desired temperature is reached or the air conditioning system is turned off.

Typical modern air conditioning systems also include additional components such as cabin air filters, sensors, and electronic controls to adjust the temperature and airflow.

In a conventional non-electric vehicle, the refrigerant compressor of the AC system is driven by the engine crankshaft via a belt or the like. In recent years, trends are moving toward electric refrigerant compressors (also referred to as refrigerant E-compressors), i.e., compressors that include their own electric motor for driving the compressor. Of course, for BEVs, the refrigerant E-compressor is the only viable option. Furthermore, in BEVs the refrigerant E-compressor may also be used for cooling various power electronics and/or the main battery of the vehicle.

The bearings and motor rotor of a refrigerant E-compressor require cooling. Various schemes have been proposed for cooling the bearings and rotor. In one scheme, a portion of the pressurized refrigerant from the compressor outlet is bled off and fed back into a cooling flow path for the rotor and bearings. The flow rate and pressure of the cooling portion of refrigerant are regulated by an electronic expansion valve disposed externally of the compressor unit. This scheme entails additional cost for the external circuit and expansion valve. Windage losses may also be higher than desired because the cooling flow rate may not be optimized in all operating conditions.

Another proposed cooling scheme involves cooling the rotor and bearings with refrigerant that leaks past the back disk of the compressor wheel. For this scheme to work, the leakage flow rate must be relatively high, which results in a significant degradation of compressor efficiency.

There is a need for improvements in refrigerant E-compressors that can substantially reduce or eliminate the problems associated with such conventional bearing cooling schemes.

SUMMARY OF THE DISCLOSURE

In accordance with one embodiment of the invention, a refrigerant E-compressor comprises:

- a housing assembly comprising a compressor housing and a motor housing affixed to the compressor housing;
- a compressor wheel affixed to a shaft and contained within the compressor housing;
- bearings rotatably supporting the shaft and contained within the motor housing;
- a motor stator contained within the motor housing, and a motor rotor affixed about the shaft and contained within the motor housing;
- the compressor housing defining a refrigerant inlet leading refrigerant into the compressor wheel, a diffuser, and a volute for collecting pressurized refrigerant discharged from the compressor wheel and diffused through the diffuser;
- a primary refrigerant flow path defined in the compressor housing and leading from the volute to a refrigerant outlet;
- a cooling flow path defined in the motor housing for supplying a flow of refrigerant for cooling the motor rotor and the bearings; and
- a fixed orifice disposed within the housing assembly, the fixed orifice connecting the primary refrigerant flow path to the cooling flow path such that the flow of refrigerant for cooling the bearings passes through the fixed orifice and is regulated thereby.

The appropriate or optimum size of the fixed orifice can readily be determined empirically through a series of tests of the refrigerant E-compressor using a variable orifice in place of the fixed orifice. The compressor can be run at a series of different speeds with the orifice size set at a given value, and data can be recorded for each speed. The series can then be repeated multiple additional times with the orifice size set at a different value each time. The data that is recorded can include parameters indicative of the cooling effectiveness for the motor rotor and bearings, as well as parameters indicative of compressor efficiency, for example. The optimum orifice size can be based, for example, on a chosen compromise between cooling effectiveness and compressor efficiency.

The fixed orifice of the invention can also be referred to as a fixed expansion valve, because a function of the fixed orifice is to induce a pressure drop, and corresponding temperature drop, in the pressurized refrigerant bled off for cooling purposes. The resulting reduced-temperature refrigerant is then supplied to the bearing area and motor of the E-compressor for cooling thereof.

In accordance with a method aspect of the invention, a method for operating a refrigerant E-compressor as described above comprises the steps of:

bleeding off a portion of the pressurized refrigerant from the primary refrigerant flow path, the bled refrigerant constituting a bleed portion, at a point within the housing assembly before the pressurized refrigerant is discharged from the refrigerant outlet;

passing the bleed portion through a fixed orifice disposed within the housing assembly, the fixed orifice inducing decreases in pressure and temperature of the bleed portion so as to produce a reduced-temperature bleed portion; and feeding the reduced-temperature bleed portion into the cooling flow path for cooling the motor rotor and the bearings.

BRIEF DESCRIPTION OF THE DRAWINGS

Having described the present disclosure in general terms, reference will now be made to the accompanying drawing(s), which are not necessarily drawn to scale, and wherein.

DETAILED DESCRIPTION OF THE DRAWINGS

The present disclosure will now be described in fuller detail with reference to the above-described drawings, which depict some but not all embodiments of the invention (s) to which the present disclosure pertains. These inventions may be embodied in various forms, including forms not expressly described herein, and should not be construed as limited to the particular exemplary embodiments described herein. In the following description, like numbers refer to like elements throughout.

Figure 1:
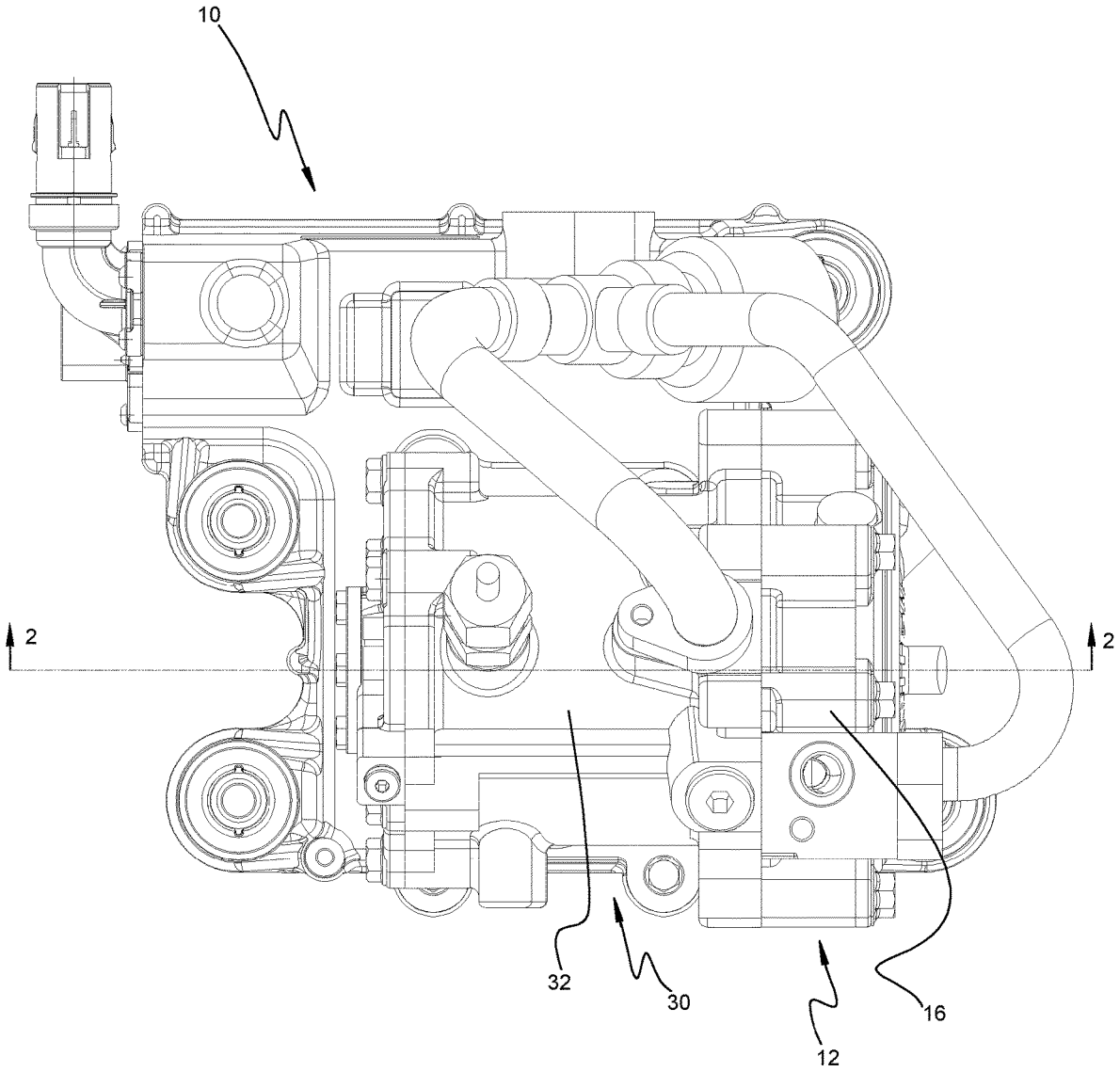
FIG. 1 is a top view of a refrigerant E-compressor in accordance with an embodiment of the invention.
Figure 2:
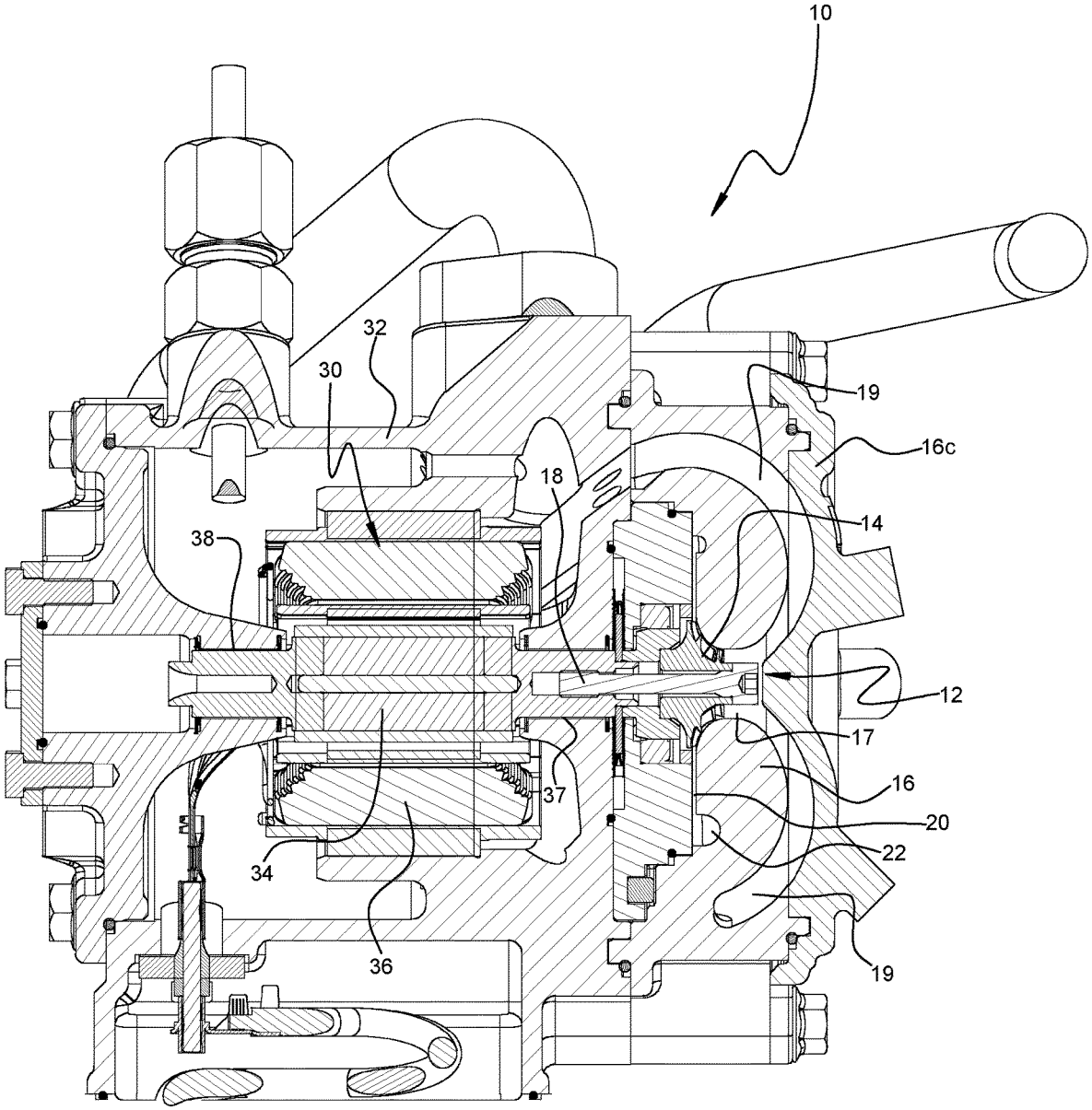
FIG. 2 is a cross-sectional view along line 2-2 in FIG. 1.
Figure 3:
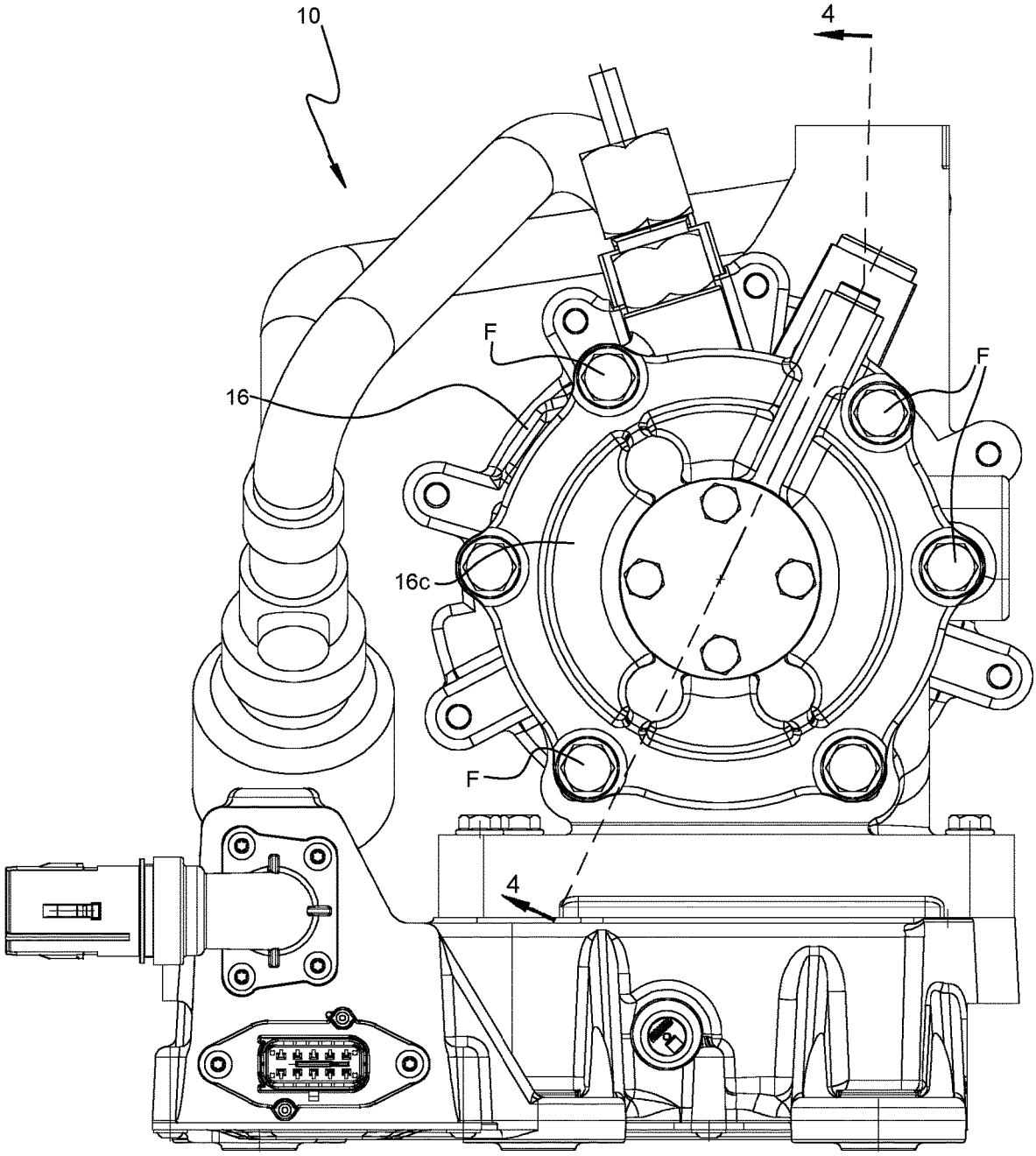
FIG. 3 is an axial end view of the E-compressor of FIG. 1.

FIGS. 1-6 depict various views of a centrifugal-type refrigerant E-compressor 10 in accordance with one embodiment of the present invention. With primary reference to FIG. 2, the refrigerant E-compressor comprises a centrifugal compressor 12 coupled with an electric motor 30. The compressor 12 includes a centrifugal compressor wheel 14 contained within a compressor housing comprising a main compressor housing 16 and a separately formed cover 16*c* that is affixed to the main compressor housing via fasteners F (FIG. 3). The compressor wheel is affixed to a shaft 18. The main compressor housing 16 defines a refrigerant inlet 17 through which refrigerant is led axially into the compressor wheel 14. Unpressurized refrigerant returning from the vehicle AC system is supplied to the inlet 17 via a plurality of refrigerant supply passages 19 (FIGS. 2, 4, and 6) defined partially in the main compressor housing 16 and partially in the cover 16*c*. The compressor housing also defines a diffuser 20. Refrigerant that has passed through the compressor wheel and has been compressed to a higher pressure is discharged radially outwardly from the wheel and passes through the diffuser into a volute 22 that collects the pressurized refrigerant. From the volute, the pressurized refrigerant is fed through the refrigerant loop of the AC system of a vehicle (not shown).

The motor 30 for the refrigerant compressor comprises a motor housing 32 that contains the motor components. The motor components include a motor rotor 34 that surrounds the shaft 18 and is affixed thereto, and a motor stator 36 that surrounds the rotor. The motor 30 is illustrated and described rather schematically herein because the details of the motor construction and operation are not particularly pertinent to the invention. The important aspect of the motor for present purposes is that it produces heat during operation and hence requires cooling. The shaft 18 is rotatably supported by a front bearing 37 and a rear bearing 38 contained within the motor housing. These bearings also require cooling.

Figure 4:
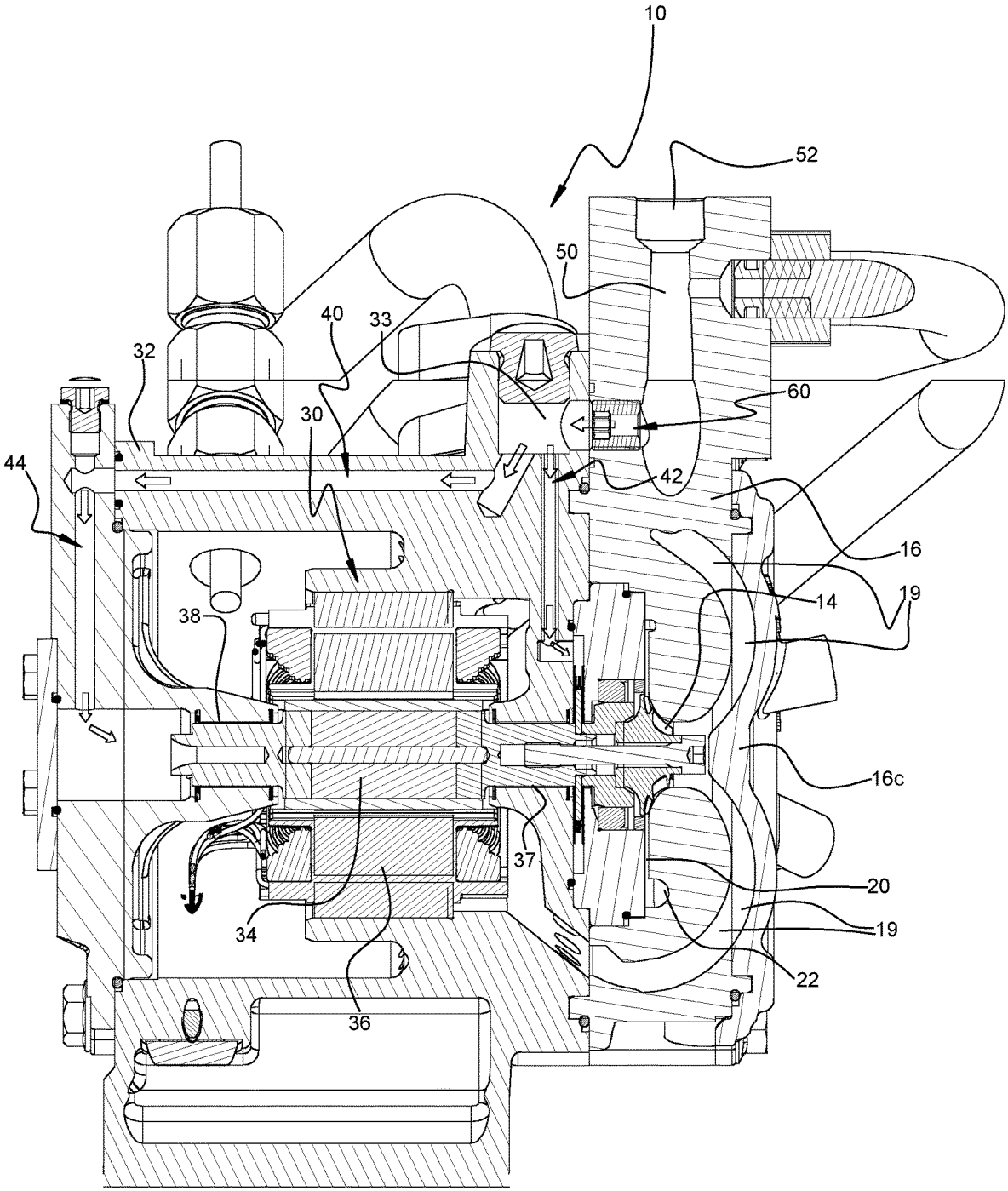
FIG. 4 is a cross-sectional view along line 4-4 in FIG. 3.
Figure 5:
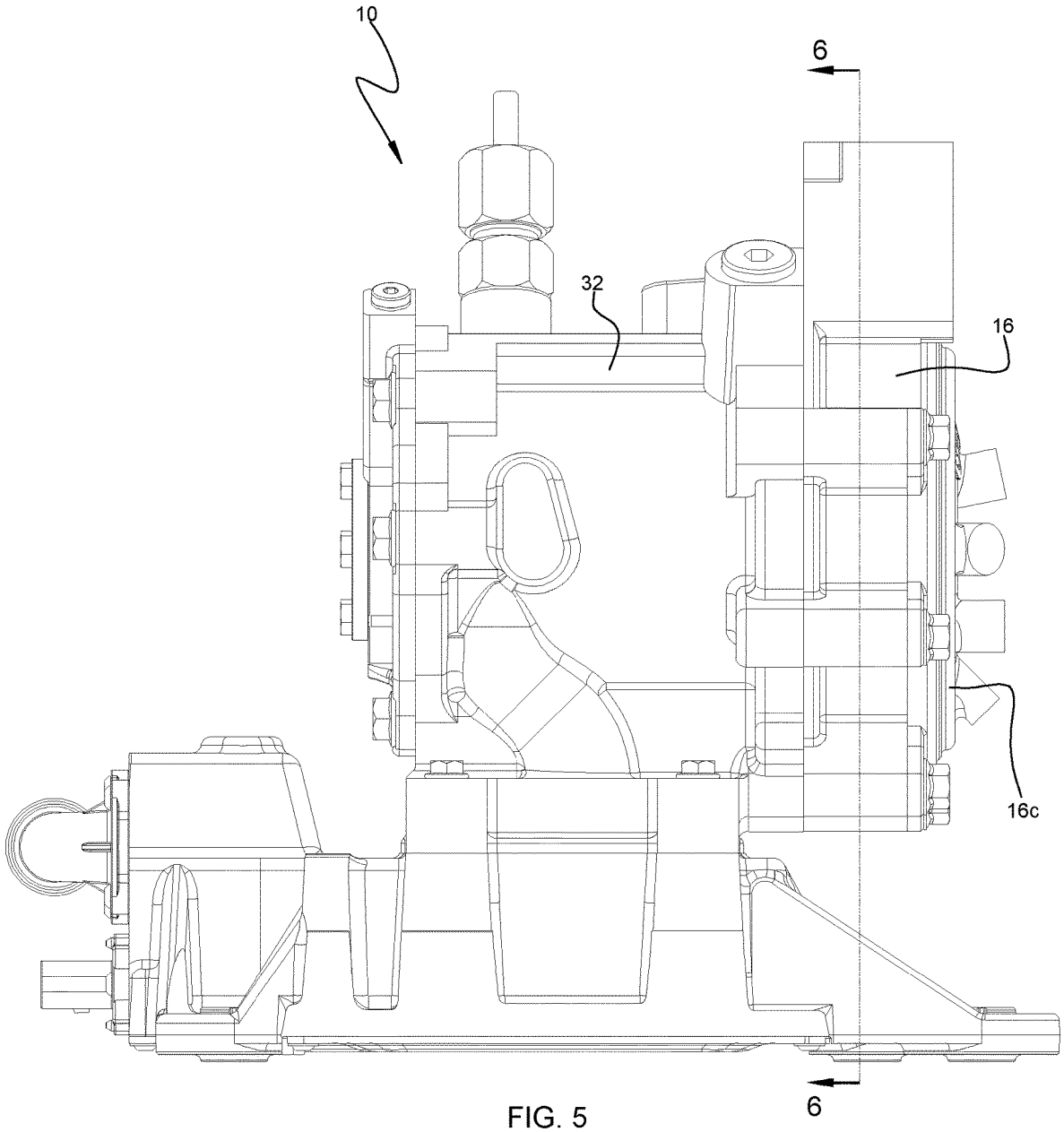
FIG. 5 is a side view of the E-compressor of FIG. 1.
Figure 6:
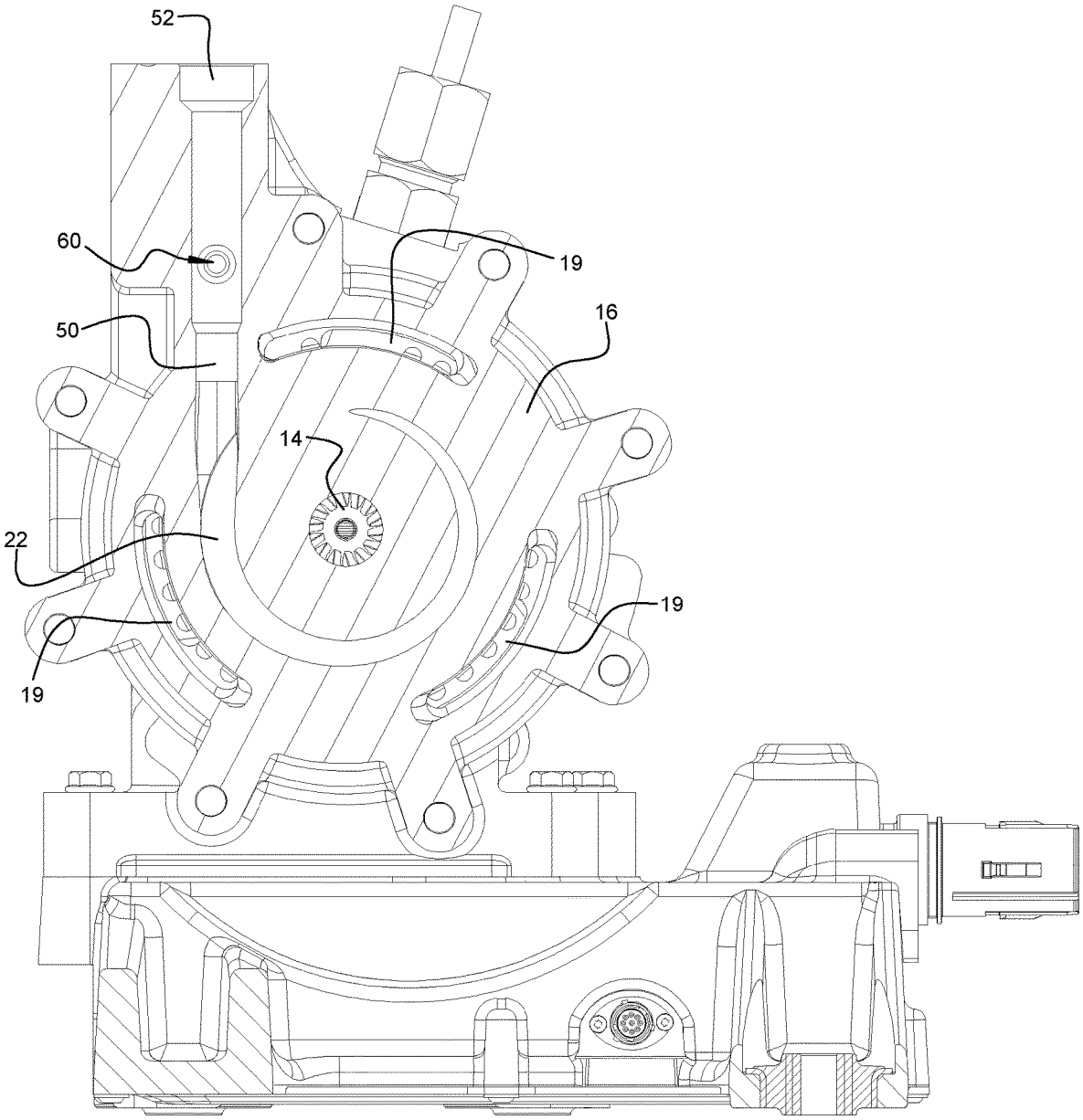
FIG. 6 is a cross-sectional view along line 6-6 in FIG. 5.

The present invention provides advantageous arrangements for bleeding off a portion of refrigerant from the main flow being supplied to the vehicle AC system, and regulating the supply of that bleed portion to the motor rotor and bearings to cool these components. In accordance with the invention, the regulation of the cooling flow is accomplished using a fixed orifice, also referred to an a fixed expansion valve. With reference to FIGS. 4 and 6, the fixed orifice 60 is contained within the housing assembly of the E-compressor; in the illustrated embodiment the orifice is within the main compressor housing 16, but alternatively it could be contained within the motor housing 32 instead. The main compressor housing 16 defines a primary refrigerant flow path 50 leading refrigerant from the volute 22 to a refrigerant outlet 52 through which pressurized refrigerant is supplied to the vehicle AC system. The motor housing 32 defines a cooling flow path 40 for refrigerant to be supplied to the motor rotor 34 and the bearings 37 and 38. The cooling flow path includes a front branch 42 for the front bearing 37 and a rear branch 44 for the rear bearing 38. The fixed orifice 60 is disposed between the primary refrigerant flow path 50 and the cooling flow path 40 such that a portion of the refrigerant flowing in the primary refrigerant flow path 50 is bled off through the fixed orifice 60 and fed to the cooling flow path 40. Specifically, the motor housing 32 defines a plenum 33 (FIG. 4) into which the bled refrigerant is fed after passing through the fixed orifice, and the plenum is connected to the cooling flow path 40. The fixed orifice regulates the flow of refrigerant for cooling the bearings.

The size of the orifice—i.e., the minimum flow area of the orifice—is related to the flow rate of refrigerant through the orifice. Thus, for a given total pressure of the refrigerant entering the orifice, the orifice size will determine the flow rate; the smaller the orifice, the larger the pressure drop across the orifice and the smaller the flow rate; conversely, the larger the orifice, the smaller the pressure drop and the larger the flow rate.

In turn, the flow rate of refrigerant through the orifice is related to the cooling effectiveness for the bearings, and to the efficiency of the compressor. The larger the cooling flow rate through the orifice (as a percentage of total refrigerant flow rate through the compressor), the greater the cooling effectiveness but the lower the compressor efficiency; conversely, the smaller cooling flow rate percentage, the lesser the cooling effectiveness but the greater the compressor efficiency. The size of the orifice can be selected so as to strike a desired compromise between cooling effectiveness and compressor efficiency.

The appropriate or optimum orifice size can be empirically determined through a series of tests of the E-compressor in which a variable orifice is employed in place of the fixed orifice. The compressor can be run at a series of different speeds with the orifice size set at a given value, and data can be recorded for each speed. The series can then be repeated multiple additional times with the orifice size set at a different value each time. The data that is recorded can include parameters indicative of the cooling effectiveness for the motor rotor and bearings, as well as parameters indicative of compressor efficiency, for example. The optimum orifice size can be based, for example, on a chosen compromise between cooling effectiveness and compressor efficiency.

The present invention can provide distinct advantages over prior art arrangements for cooling the bearings of an E-compressor. First, the E-compressor in accordance with embodiments of the invention does not require external piping for bleeding off a portion of the refrigerant and routing it back into the bearing areas of the compressor. The fixed orifice and cooling flow passages are all located internally within the compressor, obviating the need for any external piping. Second, the E-compressor of the invention does not require an electronic expansion valve, instead employing a simpler and less-costly fixed orifice that is not subject to malfunction. Third, because the cooling of the bearings is not accomplished by using leakage flow from the back disk area of the compressor wheel, the clearances for the wheel can be substantially reduced to reduce leakage flow, thereby improving compressor efficiency.

Persons skilled in the art, on the basis of the present disclosure, will recognize that modifications and other embodiments of the inventions described herein can be made without departing from the inventive concepts described herein. Specific terms used herein are employed for explanatory purposes rather than purposes of limitation. Accordingly, the inventions are not to be limited to the specific embodiments disclosed, and modifications and other embodiments are intended to be included within the scope of the appended claims.

What is claimed is:

1. A refrigerant E-compressor, comprising:

a housing assembly comprising a compressor housing and a motor housing affixed to the compressor housing;

a compressor wheel affixed to a shaft and contained within the compressor housing;

bearings rotatably supporting the shaft and contained within the motor housing;

a motor stator contained within the motor housing, and a motor rotor affixed about the shaft and contained within the motor housing;

the compressor housing defining a refrigerant inlet leading refrigerant into the compressor wheel, a diffuser, a volute for collecting pressurized refrigerant discharged from the compressor wheel and diffused through the diffuser, and a primary refrigerant flow path extending from the volute to a refrigerant outlet;

a cooling flow path defined in the motor housing for supplying a flow of refrigerant for cooling the motor rotor and the bearings, the cooling flow path including a front branch directed toward a from bearing and a rear branch directed toward a rear bearing;

a plenum formed in the motor housing and arranged between the primary refrigerant flow path and the cooling flow path, the plenum encircling the shaft in a region adjacent the motor rotor; and a fixed orifice integrally formed within a wall of the primary refrigerant flow path at a location downstream of the volute and upstream of the refrigerant outlet, the fixed orifice fluidly connecting the primary refrigerant flow path to the plenum such that a portion of the refrigerant flowing in the primary refrigerant flow path is bled through the orifice into the plenum and then supplied from the plenum to the cooling flow path for cooling the motor rotor and the bearings; and wherein the refrigerant is diverted through the fixed orifice without use of external valves or external piping.

2. The refrigerant E-compressor of claim 1, wherein the compressor housing comprises a main compressor housing and a separately formed cover that is affixed to the main compressor housing by fasteners, the main compressor housing defining the refrigerant inlet, the volute, and the primary refrigerant flow path.

3. The refrigerant E-compressor of claim 2, wherein the fixed orifice is disposed within the main compressor housing.

4. The refrigerant E-compressor of claim 2, further comprising a plurality of refrigerant supply passages defined partially in the main compressor housing and partially in the cover, the refrigerant supply passages being connected to the refrigerant inlet.

5. A method of operating a refrigerant E-compressor comprising: a housing assembly comprising a compressor housing and a motor housing affixed to the compressor housing; a compressor wheel affixed to a shaft and contained within the compressor housing; bearings rotatably supporting the shaft and contained within the motor housing; a motor stator contained within the motor housing, and a motor rotor affixed about the shaft and contained within the motor housing; the compressor housing defining a refrigerant inlet leading refrigerant into the compressor wheel, a diffuser, a volute for collecting pressurized refrigerant discharged from the compressor wheel and diffused through the diffuser, and a primary refrigerant flow path extending from the volute to a refrigerant outlet; and a cooling flow path defined in the motor housing for supplying refrigerant for cooling the motor rotor and the bearings, the cooling flow path including a front branch directed toward a front bearing and a rear branch directed toward a rear bearing; and a plenum formed in the motor housing and arranged between the primary refrigerant flow path and the cooling flow path, the plenum encircling the shaft in a region adjacent the motor rotor; the method comprising the steps of:

bleeding off a portion of the pressurized refrigerant, constituting a bleed portion, from the primary refrigerant flow path at a location downstream of the volute and upstream of the refrigerant outlet;

passing the bleed portion through a fixed orifice integrally formed within a wall of the primary refrigerant flow path, the fixed orifice inducing decreases in pressure and temperature of the bleed portion so as to produce a reduced-temperature bleed portion and discharging the reduced-temperature bleed portion into the plenum; and feeding the reduced-temperature bleed portion from the plenum into the cooling flow path via the front branch and the rear branch for cooling the motor rotor and the bearings; and wherein the bleed portion is diverted through the fixed orifice without use of external valves or external piping.

6. The refrigerant E-compressor according to claim 1, wherein the plenum is configured to distribute refrigerant from the fixed orifice substantially uniform between the front branch and the rear branch of the cooling flow path.

7. The refrigerant E-compressor according to claim 1, wherein the fixed orifice is further configured to regulate flow based upon its diameter and a pressure differential between an inlet to the fixed orifice and outlet from the fixed orifice.

8. The refrigerant E-compressor according to claim 7, wherein the fixed orifice is further configured to regulate flow based upon at least one of orifice size, fluid properties or viscosity and pressure conditions.

9. The method of operating refrigerant E-compressor according to claim 5, wherein the compressor housing comprises a main compressor housing and a separately formed cover that is affixed to the main compressor housing by fasteners, the main compressor housing defining the refrigerant inlet, the volute, and the primary refrigerant flow path.

10. The method of operating refrigerant E-compressor according to claim 9, further comprising the steps of disposing the fixed orifice within the main compressor housing.

11. The method of operating refrigerant E-compressor according to claim 10, wherein the refrigerant E-compressor further comprises a plurality of refrigerant supply passages defined partially in the main compressor housing and partially in the cover, the refrigerant supply passages being connected to the refrigerant inlet.

12. The method of operating refrigerant E-compressor according to claim 11, further comprising the steps of using the plenum formed in the motor housing to receive a portion of the refrigerant flowing in the primary refrigerant flow path bled off through the fixed orifice and to feed the received portion fed-into the cooling flow path.

13. The method of operating refrigerant E-compressor according to claim 12, further comprising the steps of configuring the fixed orifice to regulate flow based upon its diameter and a pressure differential between an inlet to the fixed orifice and outlet from the fixed orifice.

14. The method of operating refrigerant E-compressor according to claim 13, further comprising the steps of configuring the fixed orifice to regulate flow based upon at least one of orifice size, fluid properties or viscosity and pressure conditions.

15. The refrigerant E-compressor according to claim 1, wherein the fixed orifice is formed in a wall portion of the primary refrigerant flow path upstream of the refrigerant outlet.

16. The refrigerant E-compressor according to claim 1, wherein the fixed orifice is defined by a radially extending passage extending from the primary refrigerant flow path into a plenum formed in the housing assembly.

17. The refrigerant E-compressor according to claim 16, wherein the plenum is annular and encircles the shaft in a region adjacent the motor rotor.

18. The refrigerant E-compressor according to claim 1, wherein a flow area of the front branch and a flow area of the rear branch are selected to provide a predetermined division of the refrigerant flow between the front bearing and the rear bearing.

19. The refrigerant E-compressor according to claim 1, wherein the housing assembly is configured such that the fixed orifice, the primary refrigerant flow path, and the cooling flow path are all integrally formed within the walls of the housing assembly.

* * * * *